US007972200B2

(12) United States Patent
Stanfield

(10) Patent No.: US 7,972,200 B2
(45) Date of Patent: Jul. 5, 2011

(54) ABRADING WHEEL WITH SINTERED METAL CORE

(75) Inventor: Charles K. Stanfield, Crete, IL (US)

(73) Assignee: B&J Rocket America, Inc., Middlebury, IN (US)

( * ) Notice: Subject to any disclaimer, the term of this patent is extended or adjusted under 35 U.S.C. 154(b) by 0 days.

(21) Appl. No.: 11/962,782

(22) Filed: Dec. 21, 2007

(65) Prior Publication Data

US 2009/0163128 A1 Jun. 25, 2009

(51) Int. Cl.
*B23F 21/03* (2006.01)

(52) U.S. Cl. ..... 451/548; 125/15

(58) Field of Classification Search ..... 451/548; 125/15; 51/309
See application file for complete search history.

(56) References Cited

U.S. PATENT DOCUMENTS

| | | | | | |
|---|---|---|---|---|---|
| 2,818,850 | A * | 1/1958 | Schwarzkopf et al. | ..... | 125/15 |
| 4,262,650 | A * | 4/1981 | Ferrand et al. | ..... | 125/15 |
| 5,033,175 | A | 7/1991 | Jensen | | |
| 5,054,177 | A | 10/1991 | Jensen | | |
| 5,075,942 | A | 12/1991 | Jensen | | |
| 5,133,782 | A * | 7/1992 | Wiand | ..... | 51/295 |
| 5,193,280 | A * | 3/1993 | Jackson | ..... | 30/350 |
| 5,239,784 | A | 8/1993 | Stanfield | | |
| 5,283,935 | A | 2/1994 | Jensen | | |
| 5,461,762 | A | 10/1995 | Jensen | | |
| 5,504,981 | A | 4/1996 | Jensen et al. | | |
| 5,647,698 | A | 7/1997 | Jensen | | |
| 5,871,005 | A * | 2/1999 | Sueta | ..... | 125/15 |
| 5,891,206 | A * | 4/1999 | Ellingson | ..... | 51/309 |
| 6,110,031 | A * | 8/2000 | Preston et al. | ..... | 451/541 |
| 6,682,272 | B2 | 1/2004 | Stanfield | | |
| 6,712,062 | B2 * | 3/2004 | Wildenburg | ..... | 125/15 |
| 6,752,709 | B1 * | 6/2004 | Skibo et al. | ..... | 451/547 |
| 7,210,474 | B2 * | 5/2007 | Gaida et al. | ..... | 125/15 |
| 2002/0002971 | A1 * | 1/2002 | Spangenberg | ..... | 125/15 |
| 2002/0115399 | A1 * | 8/2002 | Lee et al. | ..... | 451/547 |
| 2003/0019489 | A1 * | 1/2003 | Ogata | ..... | 125/15 |

* cited by examiner

*Primary Examiner* — Maurina Rachuba
(74) *Attorney, Agent, or Firm* — Thomas E. Hill; Wildman, Harrold, Allen & Dixon LLP

(57) ABSTRACT

Article and method of making an abrading wheel having a sintered metal core and radially inward openings having curved inner edges to reduce stress in operation and to improve the ability of the wheel to clear residue from the wheel during operation.

1 Claim, 2 Drawing Sheets

ABRADING WHEEL WITH SINTERED METAL CORE

FIELD OF THE INVENTION

The present invention relates to abrading wheels of the type used to finish the surface of a rubber product to form a desired surface smoothness. This type of abrading wheel may be used in the retreading of tires, for example, as well as in finishing the surface of rubber rollers to a predetermined tolerance.

BACKGROUND OF THE INVENTION

In the past, abrading wheels of this type have generally had a core of uniform thickness and diameter, to form the general shape of a disc, with tungsten carbide grit on the outer peripheral surface.

It has been found desirable to provide radial grooves or openings in the finished wheel. These grooves act as regions of accumulation for the material being removed and facilitate release of the material from the abrading wheel. Without the radial grooves or openings, the grit surface would tend to accumulate material and become packed with "dust", thus reducing its ability to remove further material from the work piece, by clogging the interstices of the grit surface.

In the past, the radial openings have been formed by machining through the peripheral surface (or rim) of the disc-shaped wheel and into the central portion of the core. This is an expensive process; six radial grooves typically are formed in each abrading wheel. Moreover, the cutting process left sharp corners which provided regions for accumulating the residue of the abrading process, and created regions of stress in the wheel.

SUMMARY OF THE INVENTION

An abrading wheel has a core made of sintered metal. The core may be in the general form of a disc having a plurality of peripheral sectors of equal angular extension. Adjacent sectors are separated by a generally U-shaped radial opening having a smoothly curved inner, central surface to avoid accumulation of the material removed from a work piece while reducing stress on the smooth openings, and to reduce stress in the core. The shape of the radial openings also promotes the flow of air through the openings to remove any accumulated residue.

The use of powder metal technology to manufacture the core has many advantages, including: lower manufacturing cost because there is no need to machine the piece; the ability to maintain close dimensional tolerances without machining; and adaptability to a wide variety of alloy systems to accommodate different applications.

DETAILED DESCRIPTION OF THE PREFERRED EMBODIMENT

Figures 1, 2, 3, 4, 5:
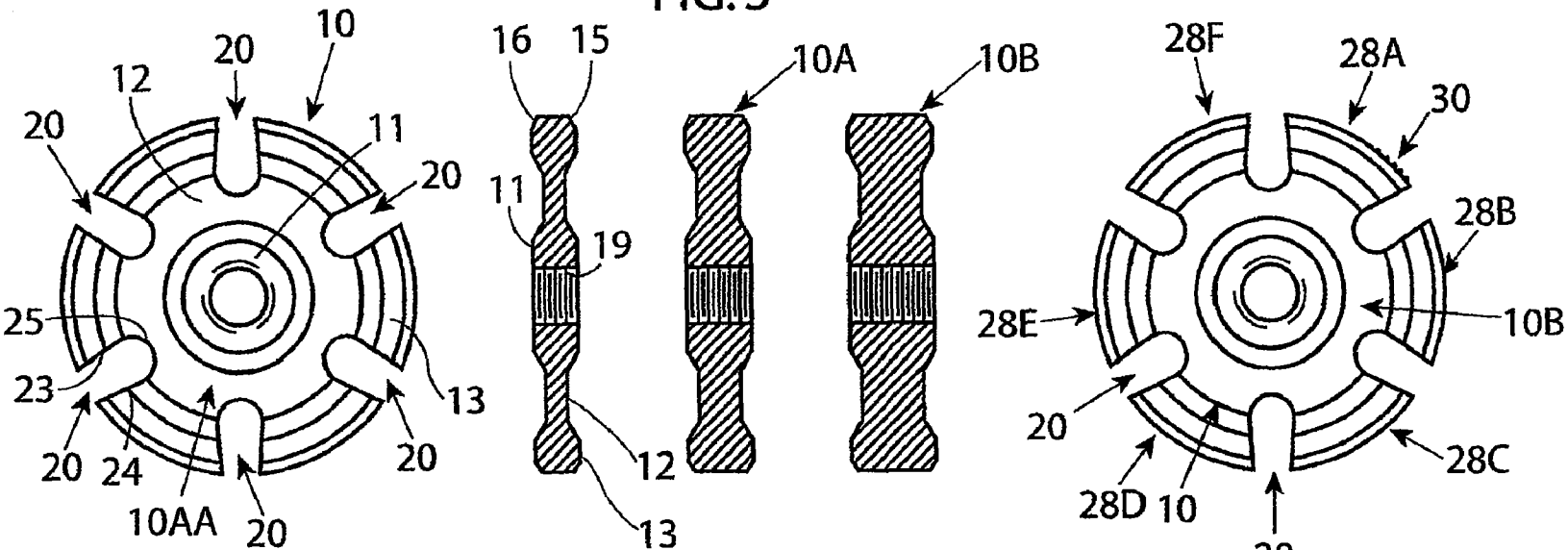
FIG. 1 is an elevational side view of a core for an abrading wheel constructed according to the present invention.
FIG. 2 is a vertical cross-sectional view of the core of FIG. 1.
FIG. 3 is a cross-sectional view similar to FIG. 2 of a core of greater thickness than that seen in FIG. 2.
FIG. 4 is a cross-sectional view of a core for an abrading wheel having a thickness slightly greater than that shown in FIG. 3.
FIG. 5 is an elevational side view of a finished abrading wheel formed with the core of FIG. 1.

Referring first to FIG. 1, there is seen one side of a core 10 for an abrading wheel. The other side may be identical, and need not be described further. As illustrated in FIGS. 2-4, the thickness of the core illustrated may vary, with the side surfaces remaining the same. In general, although FIGS. 1-5 are not precisely to scale, they are representative of typical dimensions for the type of abrading wheel to which the present invention is related.

Referring first to FIGS. 1-4, reference numeral 10 generally designates a sintered metal core for an abrading wheel. A complete abrading wheel is shown in FIG. 5 and will be discussed further. The wheel of FIG. 5 includes the core 10 of FIG. 1, but also has an abrading peripheral surface.

The core 10 has first and second identical sides, as mentioned. The core 10 includes a central portion 11 of a relatively larger thickness (see FIG. 2), which is surrounded by an annular segment 12 of relatively thinner thickness. Outward of the thinner annular segment 12 is another annular segment or rim 13 having a similar thickness as the central portion 11, and located adjacent the perimeter of the core, forming a rim. The outer edges of the rim 13 are beveled as indicated at 15, 16 in FIG. 2.

An opening 19 (FIG. 2) is formed in the center of the central portion 11 for mounting the abrading wheel.

Turning once more to FIG. 1, a series of six inwardly extending radial openings generally designated 20 extend from the outer perimeter of the core 10 radially inward toward the center, each in the general form of a U. Each of the radial U-shaped openings 20 (referring to the one in the lower left-hand portion of FIG. 1) includes first and second sidewall edges 23, 24 which are generally straight to define the sides of the opening 20 (which narrows in proceeding radially outward from the center). The innermost edge of each radial opening 20 may be continuously curved as at 25 in FIG. 1.

There are 6 radial openings 20 in FIG. 1, and they are equally spaced about the center of the core 10 at 60°. That is, the radial center of each of the openings 20 defines a 60° angle with a corresponding imaginary line extending through the radial center of each of the adjacent radial openings.

Turning now to FIGS. 2-4, the thickness of the core 10 may vary, depending upon the desired application. As seen in FIG. 3, the core 10A is relatively thick as compared with the core 10 shown in FIG. 2; and the core 10B shown in FIG. 4 is relatively thicker than the core 10A shown in FIG. 3. Corresponding thicknesses for each of the cores 10A and 10B are similarly scaled to a larger dimension in FIGS. 3 and 4.

Turning now to FIG. 5, there is shown a side view of a completed abrading wheel, including core 10 as has been described. It will be observed that adjacent radial openings 20 divide the perimeter of the core 10 into six segments. In FIG. 5, the segments are designated respectively 28A-28F. The outer perimeter of each of the segments 28A-28F is provided with tungsten carbide grit, as designated at 30 in FIG. 5, to provide the abrading surface.

Figure 6:
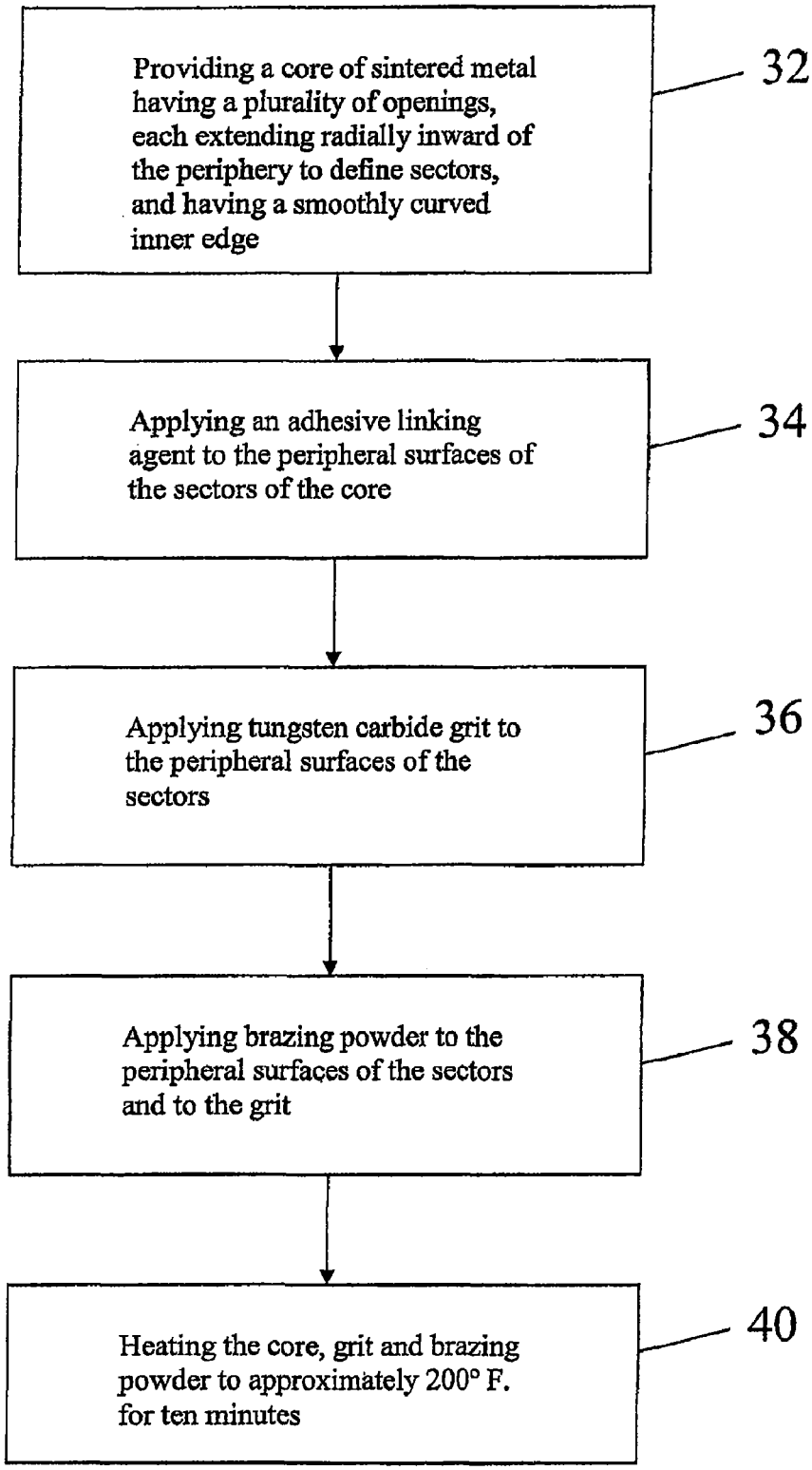
FIG. 6 is a flow chart showing the steps in a method of making an improved abrading wheel according to the invention.

Referring to FIG. 6, the abrading wheel shown in FIG. 5 is made as follows:

(1) A core as shown and described is provided, as illustrated in block 32;

(2) In block 34, an adhesive linking agent such as polyvinyl alcohol is applied to the outer perimeter surface of the individual segments of the sintered metal core 10;

(3) Next, in block 36, the tungsten carbide grit 30 is applied over the binder (the grit may be poured as the core is rotated);

(4) Next, in block 38, brazing material in powder form (which may be nickel or copper) is applied to the entire perimeter surface, including the tungsten carbide grit which is adhesively secured to the perimeter; and (5) The entire product is then heated, in block 40 in an oven at approximately 2000° F. for approximately ten minutes to melt the brazing powder which, when cooled, secures the tungsten carbide grit 30 to the outer surface of the individual segments 28A-28F.

By forming the radial openings 20 as described, that is, with an increasing width (circumferential) in proceeding radially inward of the core 10, and having the innermost ends of the two straight edge sidewalls, 23, 24 joined by a smoothly curved innermost portion (25 in FIG. 1), when the ultimate abrading wheel is placed into use, typically by mounting one or more of the abrading wheels on a shaft and rotating it and then applying the rotating abrading wheel or wheels against a rubber surface to be finished or prepared for subsequent processing, the rotation of the wheel creates air current eddies passing through the openings 20 and clears dust or debris from these openings, and this reduces plugging of the grit surface or interfering with the abrading process. Moreover, the curvature of the innermost surface (25 in FIG. 1) of each radially inwardly extending opening 20 reduces stress in the base of each sector during operation, as compared with the square or angular corners of prior abrading wheel cores. Finally, the use of sintered metal to make the core reduces manufacturing costs by eliminating the prior practice of machining the core to attain the desired shape of the radial openings which define the sectors.

Having thus disclosed in detail the preferred embodiment of the invention, persons skilled in the art will be able to modify the certain of the materials, structure and process steps which have been disclosed herein, while continuing to practice the principle in the inventions; and it is, therefore, intended that all such modifications and substitutions be covered as they are embraced within the spirit and scope of the appended claims.

The invention claimed is:

1. An abrading wheel for finishing the surface of a rubber product, said abrading wheel comprising:

a unitary, solid, continuous core of sintered metal having a plurality of six equally angularly spaced openings extending radially inward of the periphery of the core, each of said openings having a curved inner surface spaced outwardly of a center of said core and first and second side surfaces extending inwardly from the perimeter of said core and spaced increasingly further apart from one another in a symmetric manner in proceeding from the periphery of the core toward an associated curved inner surface to provide each of said openings with a tear-drop shape, wherein each of said curved inner surfaces is smooth to avoid accumulation of material removed from a work piece and reduce stress in the core, wherein the thickness of said core varies in proceeding from a central aperture in the core outward to its outer periphery, said core including an inner annular portion of reduced thickness radially disposed between an inner apertured center portion and an outer peripheral portion of said core, and wherein an inner end portion of each of said inwardly extending openings, including an associated curved inner surface of each of said inwardly extending openings, is disposed in the core's inner annular portion;

said openings defining a plurality of six peripheral sectors of substantially equal circumferential extension;

a binding agent disposed on an outer circumferential surface of each of said peripheral sectors; and tungsten carbide grit disposed in the form of a thin layer on said binding agent and fixed to the outer surface of each of said sectors.

* * * * *